United States Patent [19]

Aguettant et al.

[11] Patent Number: 4,653,425

[45] Date of Patent: Mar. 31, 1987

[54] APPARATUS FOR COATING A CONTINUOUSLY MOVING STRIP

[76] Inventors: Jean-Christophe Aguettant, 63 rue Montgolfier, Lyon; Roger Guillot, 10, rue Corneille, Decines (Rhone), both of France

[21] Appl. No.: 852,300

[22] Filed: Apr. 15, 1986

[30] Foreign Application Priority Data

Apr. 16, 1985 [FR] France ..... 85 06176

[51] Int. Cl.[4] ..... B05B 15/12

[52] U.S. Cl. ..... 118/326; 118/301; 118/DIG. 9

[58] Field of Search ..... 118/326, DIG. 9, 301; 98/115.2

[56] References Cited

U.S. PATENT DOCUMENTS

| | | | |
|---|---|---|---|
| 1,529,134 | 3/1925 | Kelter | 118/326 |
| 3,077,859 | 2/1963 | Cook | 118/326 |
| 3,383,054 | 5/1968 | Nugarus | 118/326 |

*Primary Examiner*—Shrive P. Beck

*Attorney, Agent, or Firm*—Karl F. Ross; Herbert Dubno

[57] ABSTRACT

An apparatus for coating a liquid on an elongated profile having a longitudinally extending front surface and a longitudinally extending back surface has a housing forming a generally closed treatment chamber and having an inlet opening and an outlet opening spaced downstream along a treatment path extending through the chamber from the inlet opening. Both openings are of a size and shape slightly larger than the section of the molding. A mist of the coating liquid is supplied to the chamber. An upwardly open channel guide extending in the chamber between the openings is formed with an upwardly open groove open longitudinally at each of the openings. This guide is generally complementary to the back surface of the molding. The molding is displaced through the chamber from the inlet to the outlet opening with its back surface in engagement with the channel guide over the groove so that the molding generally upwardly closes the groove to form same into a passage having ends open longitudinally substantially only at the inlet and outlet openings. The chamber is evacuated so as to draw outside air thereinto through the openings and into the ends of the passage.

5 Claims, 6 Drawing Figures

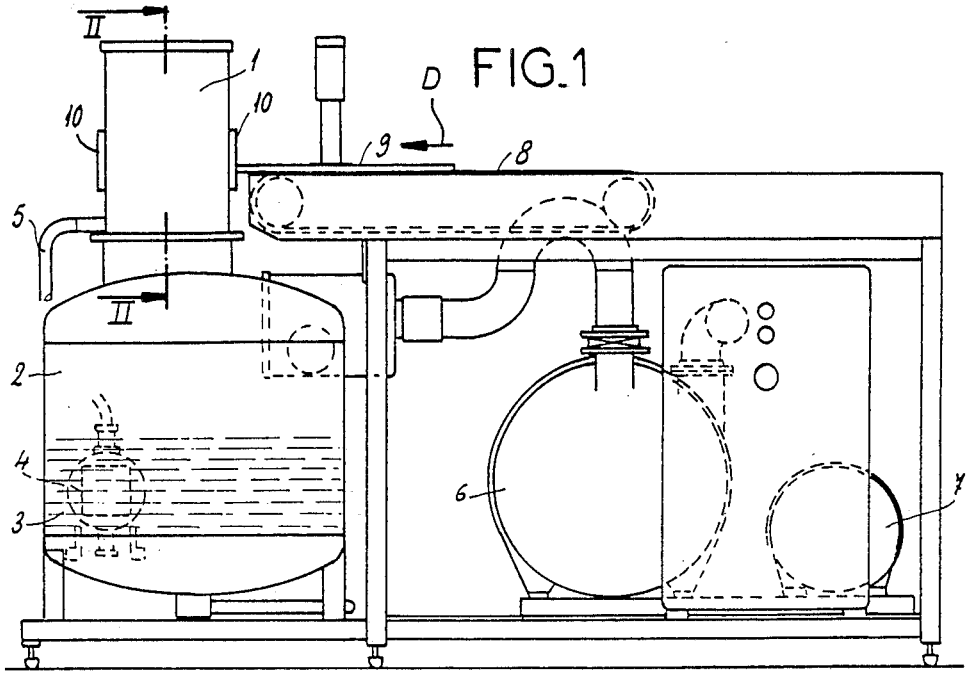
FIG.1
II
1
10
10
D
9
8
5
II
2
4
3
6
7
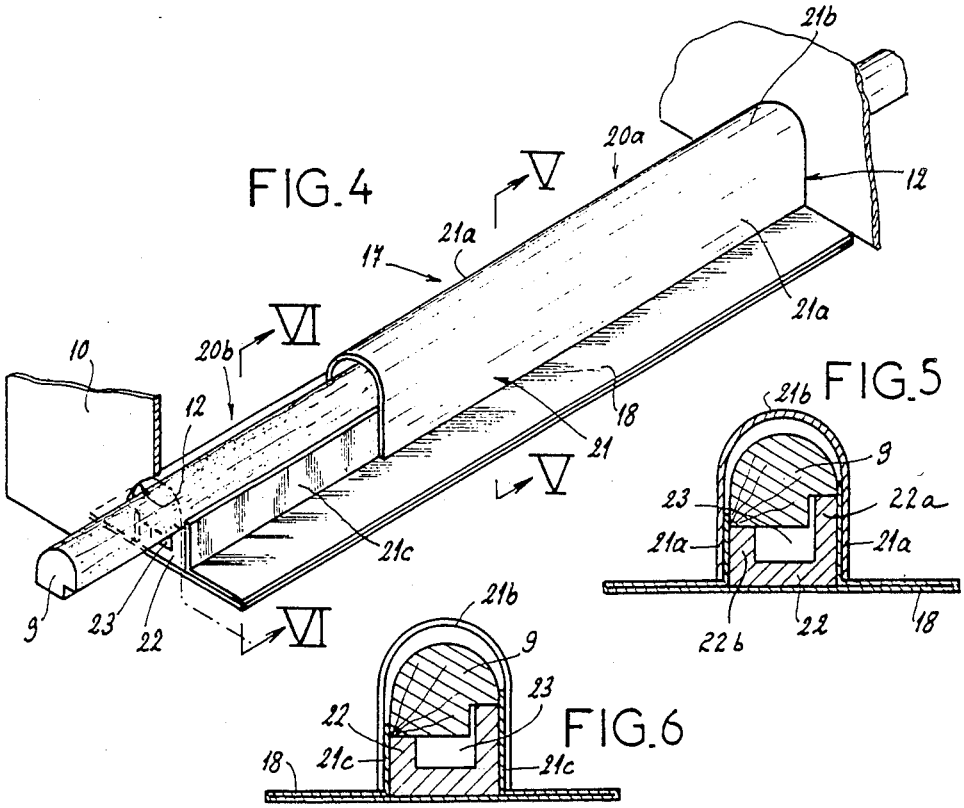
FIG.4
21b
20a
V
12
21a
17
21a
VI
10
20b
12
18
21
V
21c
9
23
22
VI
FIG.5
21b
9
23
22a
21a
21a
22b
22
18
21b
9
23
22
21c
21c
18
FIG.6

APPARATUS FOR COATING A CONTINUOUSLY MOVING STRIP

FIELD OF THE INVENTION

The present invention relates to an apparatus for the production coating of a continuously moving strip. More particularly this invention concerns an apparatus for painting a molding.

BACKGROUND OF THE INVENTION

In the mass production of prefinished moldings, which term is here intended to include any elongated element from a small bead to a wide plank, it is standard to pass the molding longitudinally through a chamber in which it is given a smooth coating of the desired finish which can be paint, varnish, or the like. Such a coating machine normally has a closed treatment chamber through which some sort of transport device passes the moldings one after the other. An atomizing device generates a mist of the coating liquid in the chamber and a vacuum pump maintains the chamber at subatmospheric pressure so that the mist can be recycled and so that it does not escape to pollute the surroundings with the often toxic volatile solvents being used. Such an arrangement applies an extremely smooth and uniform coating of liquid to the molding being treated, whether it is of wood, metal, plastic, or like material.

A major disadvantage of these devices is, however, that all surfaces of the molding are coated. On the one hand this represents a waste of the often costly coating liquid, since at least one surface of such a molding is normally never intended to be seen so coating it serves no purpose. On the other hand coating all surfaces of the molding creates a handling problem, since the still-liquid coating on the underside of the molding comes off on the downstream conveying devices. In addition if the back of the molding has been accurately milled to fit, for example, a given inset in a picture frame, the coating can change these dimensions and reduce detail, the latter being a particular problem when the molding is shaped with fine grooves adapted to receive special clips.

OBJECTS OF THE INVENTION

It is therefore an object of the present invention to provide an improved apparatus for coating a profile.

Another object is the provision of such an improved apparatus for coating a profile which overcomes the above-given disadvantages, that is which does not coat the back surface of the profile.

SUMMARY OF THE INVENTION

An apparatus for coating a liquid on an elongated profile having a longitudinally extending front surface and a longitudinally extending back surface according to this invention has a housing forming a generally closed treatment chamber and having an inlet opening and an outlet opening spaced downstream along a treatment path extending through the chamber from the inlet opening. Both openings are of a size and shape slightly larger than the section of the molding. A mist of the coating liquid is supplied to the chamber. An upwardly open channel guide extending in the chamber between the openings is formed with an upwardly open groove open longitudinally at each of the openings. This guide is generally complementary to the back surface of the molding. The molding is displaced longitudinally through the chamber along the path from the inlet to the outlet opening with its back surface in engagement with the channel guide over the groove so that the molding generally upwardly closes the groove to form same into a passage having ends open longitudinally substantially only at the inlet and outlet openings. The chamber is evacuated so as to draw outside air thereinto through the openings and into the ends of the passage.

With this arrangement only the front surface of the molding is coated. The back surface is kept completely free of the coating liquid since in effect the small amount of leakage from the passage under this back surface effectively prevents the entry of the droplets of the liquid into this area. As a result the coating liquid is used sparingly so as to economize this material. In addition detail on the back of the molding is not clogged, and the molding can be moved downstream from the apparatus, for instance on a conveyor belt, without getting the liquid on the conveyor.

DESCRIPTION OF THE DRAWING

The above and other features and advantages will become more readily apparent from the following, reference being made to the accompanying drawing in which:

FIG. 1 is a small-scale side view of the apparatus according to the present invention;

FIG. 4 is a partly sectional large-scale perspective view of a detail of the apparatus; and FIGS. 5 and 6 are cross sections taken along respective lines V—V and VI—VI of FIG. 4.

SPECIFIC DESCRIPTION

Figure 3:
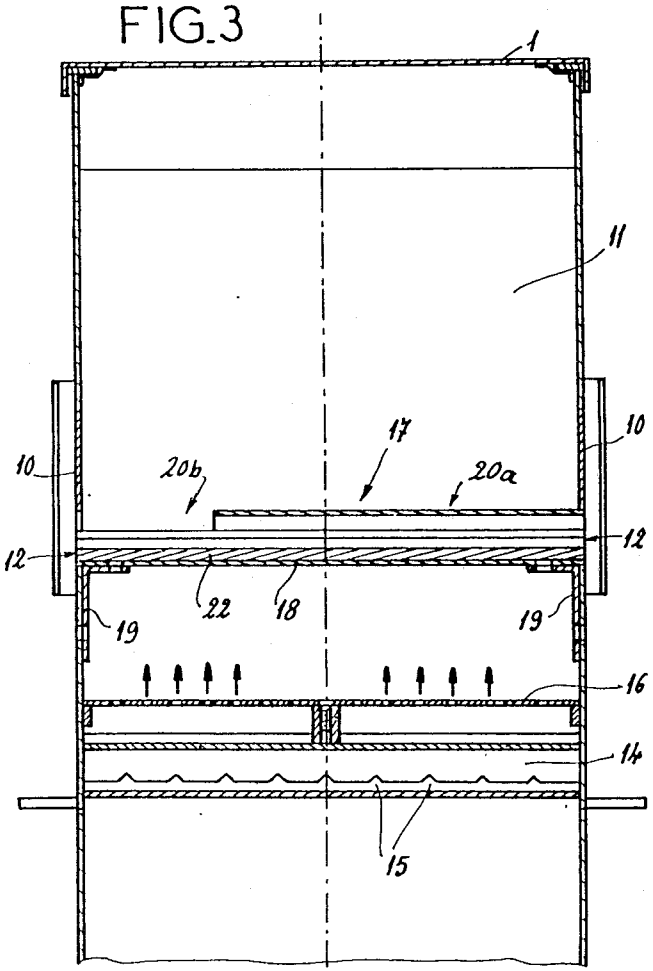
FIG. 3 is a longitudinal section taken along line III—III of FIG. 2.

As seen in FIG. 1 the apparatus according to this invention has a generally closed treatment housing 1 forming a closed treatment chamber 11 and provided above a closed container 2 holding a body 3 of a treatment liquid, e.g. paint. A pump 4 supplies this liquid to the bottom of the chamber 11 via a conduit 5. A vacuum pump 6 driven by a motor 7 creates a subatmospheric pressure in the chamber 11. A conveyor belt 8 displaces a molding 9 to be painted in a direction D through openings 12 in removable inlet and outlet doors 10 at the upstream and downstream ends of the housing 1.

Figure 2:
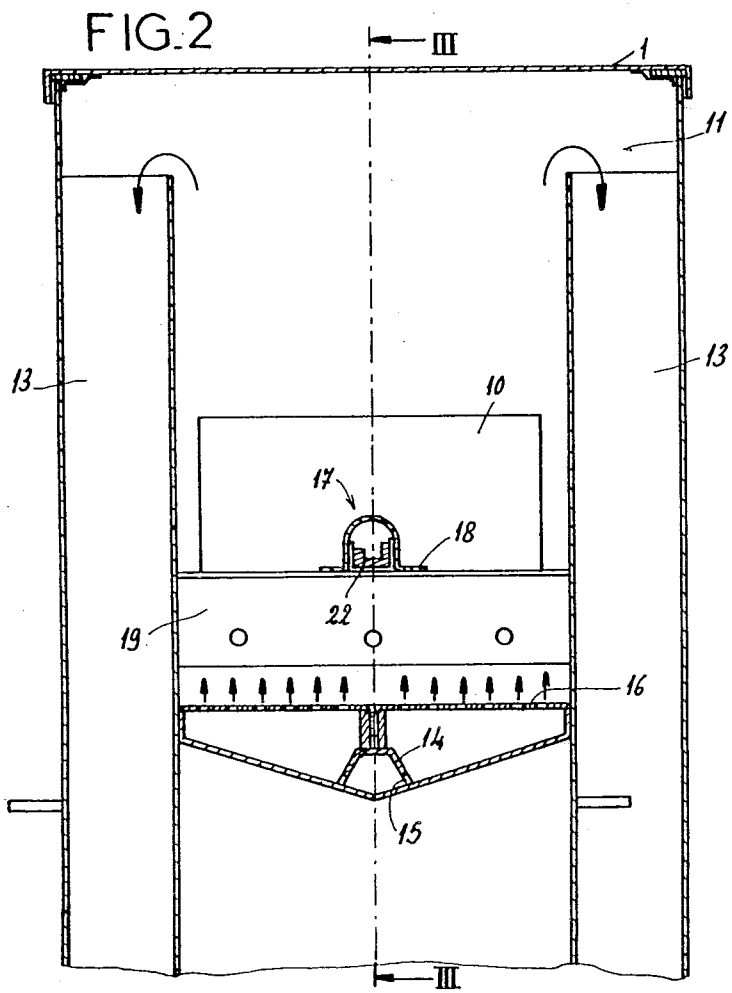
FIG. 2 is a large-scale cross section taken along line II—II of FIG. 1.

FIGS. 2 and 3 show how the conduit 5 from the pump 4 opens into a longitudinally extending conduit or manifold 14 formed along its full length on both sides with nozzle holes 15 and overlain by a screen 16. The pump 6 exhausts the chamber via large side conduits 13 that open near the top of the chamber 1, so that the liquid of the body 3 rises as a mist in the chamber 11 and then descends to rejoin the body 3. Appropriate formations are provided to return the mist drawn in at 13 to the body 3.

The molding 9 moves through the chamber 11 in a guide 17 having laterally projecting horizontal legs 18 supported at the upstream and downstream ends of the housing on flanges 19 and extending between openings 12 in the doors 10. The guide 17 has an upstream portion **20*a* and a downstream portion 20*b*, the former being constituted as a U-shaped profile 21 having as seen in FIG. 5 a pair of upright sides 21*a* joined by a downwardly U-shaped bight 21***b* to form a tunnel, and the latter only having two sides 21*c*. In addition this guide 17 comprises a full-length insert rail or channel 22 of upwardly open U-section and defining a full-length upwardly open groove 23. The rail 22 has one tall leg 22*a* and one short leg 22*b* so that the molding 9, which is here shown to be a round-top picture-frame molding, can sit flat on it with its flat normally not seen back surfaces riding on the legs 22*a* and 22*b* of the rail 22.

The groove 23 is therefore upwardly closed by the molding 9 and forms a passage open at both ends outside the chamber 11, at the door openings 12. Since there is considerable subatmospheric pressure inside the chamber 11 and since the contact regions between the bottom surfaces of the molding 9 and the legs of the channel 22 do not seal tightly, there will inherently be a continuous flow along the passage 23 and out between the molding 9 and the channel 22. In addition of course there will be a flow countercurrent to the direction D in the downstream opening 12 around the molding 9 and an opposite flow concurrent with the direction D along the tunnel part 20*a* of the profile 21, since both openings 12 surround the molding 9 with play as does the tunnel part 20*a* of the profile 21.

As a result only the upper surface of the molding 9 will be exposed to the paint mist in the chamber 11. There will be no leakage from the chamber, and none of the mist will be able to work its way into the overpressure space between the bottom surfaces of this molding 9 and the guide channel 22. These back surfaces will therefore not be painted. This not only saves paint but also leaves the back of the molding clean so that it will fit accurately to whatever it has been dimensioned form, and so that it can be transported downstream without getting paint on the conveyor.

We claim:

1. An apparatus for coating a liquid on an elongated molding profile having a longitudinally extending front surface and a longitudinally extending back surface, the apparatus comprising:

a housing forming a generally closed treatment chamber and having an inlet opening and an outlet opening spaced downstream along a treatment path extending through the chamber from the inlet opening;

means for supplying a mist of the coating liquid to the chamber;

transport means for displacing the molding longitudinally through the chamber along the path from the inlet to the outlet opening;

means including a guide supporting the molding in the chamber and including an upstream portion spacedly surrounding and shielding the entire molding and a downstream portion engaging and shielding only the back surface of the molding; and pump means for evacuating the chamber and thereby drawing outside air thereinto through the openings and through the upstream portion of the guide, whereby the mist only settles on and coats the front surface of the molding.

2. The apparatus defined in claim 1 wherein the guide is formed as a base of uniform section extending along the path between the openings; and a profile joined to the base and of downwardly U-section in the upstream portion and only having two side rails in the downstream portion.

3. The apparatus defined in claim 2 wherein the base forms an upwardly open longitudinally extending groove open at both openings.

4. The apparatus defined in claim 3 wherein the base is generally complementary to the molding back surface.

5. An apparatus for coating a liquid on an elongated molding profile having a longitudinally extending front surface and a longitudinally extending back surface, the apparatus comprising:

a housing forming a generally closed treatment chamber and having a an inlet opening and an outlet opening spaced downstream along a treatment path extending through the chamber from the inlet opening, both openings being of a size and shape slightly larger than the section of the molding;

means for supplying a mist of the coating liquid to the chamber;

an upwardly open channel guide extending in the chamber between the openings and formed with an upwardly open groove open longitudinally at each of the openings, the guide being generally complementary to the back surface of the molding;

transport means for displacing the molding longitudinally through the chamber along the path from the inlet to the outlet opening with its back surface in engagement with the channel guide over the groove, whereby the molding generally upwardly closes the groove to form same into a passage having ends open longitudinally substantially only at the inlet and outlet openings; and pump means for evacuating the chamber and thereby drawing outside air thereinto through the openings and into the ends of the passage.

* * * * *